US009464873B2

(12) United States Patent
Orlev et al.

(10) Patent No.: US 9,464,873 B2
(45) Date of Patent: Oct. 11, 2016

(54) WIDE AREA NEUTRALIZER

(76) Inventors: Nahum Orlev, Hod hasharon (IL); Alon Orlev, Hod hasharon (IL)

( * ) Notice: Subject to any disclaimer, the term of this patent is extended or adjusted under 35 U.S.C. 154(b) by 280 days.

(21) Appl. No.: 14/232,286

(22) PCT Filed: Jul. 4, 2012

(86) PCT No.: PCT/IB2012/053399

§ 371 (c)(1),
(2), (4) Date: Jan. 13, 2014

(87) PCT Pub. No.: WO2013/008138

PCT Pub. Date: Jan. 17, 2013

(65) Prior Publication Data

US 2014/0144311 A1 May 29, 2014

(30) Foreign Application Priority Data

Jul. 14, 2011 (IL) ..... 214102

(51) Int. Cl.

| | |
|---|---|
| ***F42B 23/16*** | (2006.01) |
| ***F41H 11/00*** | (2006.01) |
| ***F42B 12/20*** | (2006.01) |
| ***F42B 12/22*** | (2006.01) |
| ***F42B 12/60*** | (2006.01) |
| ***F41G 9/00*** | (2006.01) |

(52) U.S. Cl.

CPC ..... *F41H 11/00* (2013.01); *F41G 9/00* (2013.01); *F42B 12/202* (2013.01); *F42B 12/22* (2013.01); *F42B 12/60* (2013.01); *F42B 23/16* (2013.01)

(58) Field of Classification Search

CPC ..... F42B 12/56; F42B 12/58; F42B 5/03; F42B 12/32; F42B 12/60; F42B 23/16

USPC ..... 244/117 R, 131, 137.4, 2, 62, 3; 89/1.11, 1.51, 1.52

See application file for complete search history.

(56) References Cited

U.S. PATENT DOCUMENTS 2,742,889 A 4/1956 Clauss
3,332,348 A * 7/1967 Myers ..... F42B 12/50 102/369

(Continued)

FOREIGN PATENT DOCUMENTS

FR 2646232 A1 10/1990

*Primary Examiner* — Benjamin P Lee
(74) *Attorney, Agent, or Firm* — Mark M. Friedman

(57) ABSTRACT

A weapon system includes a number of WAN components, each WAN component includes a warhead, a launch mechanism for launching the warhead, an aiming mechanism for aiming the launch mechanism to launch the warhead in a desired direction, and a controller that, upon receipt of a command to aim and launch the warhead, operates the aiming mechanism to aim the warhead in the desired direction and then operates the launch mechanism to launch the warhead. The weapon system also includes a WAN component deployment mechanism for deploying the plurality of WAN components in a defended area; and a command center for instructing the controller of one or more of the WAN components to aim and launch the warhead of the each WAN component at a target that has been detected in the defended area.

17 Claims, 12 Drawing Sheets

(56) References Cited

U.S. PATENT DOCUMENTS 3,818,833 A * 6/1974 Throner, Jr. ..... F42B 10/56 102/213
4,289,073 A * 9/1981 Romer ..... F42B 12/60 102/476
4,388,869 A * 6/1983 Edleson ..... F42B 12/60 102/491
4,676,167 A * 6/1987 Huber, Jr. ..... F41B 3/04 102/393
4,750,403 A * 6/1988 Huber, Jr. ..... F41G 9/02 89/1.11
5,111,748 A * 5/1992 Thurner ..... F42B 10/56 102/387
5,313,890 A * 5/1994 Cuadros ..... F42B 12/32 102/393
5,497,705 A * 3/1996 Bredy ..... F42C 15/42 102/425
5,535,679 A * 7/1996 Craddock ..... F42B 12/32 102/389
5,760,330 A * 6/1998 Himmert ..... F42B 12/62 102/337
6,640,723 B2 * 11/2003 Spivak ..... F42B 12/58 102/483
6,641,082 B2 * 11/2003 Bevilaqua ..... B64D 5/00 244/189
6,666,145 B1 * 12/2003 Nardone ..... F42B 12/58 102/393
7,281,681 B2 * 10/2007 MacCready ..... B64C 1/26 244/59
7,305,981 B1 * 12/2007 Lin ..... F41H 13/0006 124/59
7,717,042 B2 * 5/2010 Lloyd ..... F42B 12/56 102/489
7,726,244 B1 * 6/2010 Lloyd ..... F41H 11/12 102/402
7,845,283 B2 * 12/2010 Finneral ..... F41G 7/226 102/357
7,886,648 B2 * 2/2011 Williams ..... F41H 13/0025 119/908
8,528,480 B2 * 9/2013 Seidel ..... F42B 10/02 102/492
2002/0166475 A1 * 11/2002 Brooks ..... F42B 12/60 102/489
2003/0089219 A1 * 5/2003 Gorman ..... F41H 11/02 89/1.11
2004/0011238 A1 * 1/2004 Ronn ..... F42B 12/32 102/492
2006/0021538 A1 * 2/2006 Lloyd ..... F41H 11/04 102/489
2008/0148925 A1 6/2008 O'Dwyer
2010/0132580 A1 * 6/2010 Nazdratenko ..... F41H 13/0006 102/502
2012/0048992 A1 * 3/2012 Malul ..... F42B 10/64 244/3.24

* cited by examiner

WIDE AREA NEUTRALIZER

FIELD AND BACKGROUND OF THE INVENTION

The present invention relates to weapons systems and, more particularly, to a system and method for preventing enemy incursions into a designated area.

Armed forces often struggle to halt enemy forces from entering into or crossing through certain predefined areas. These areas may include stratigical points, well hidden areas in which enemy forces may engage in hostile activity without being traced, or physical borders. Enemy forces may attempt to enter or take over stratigical areas in order to engage in missile launching attempts. Otherwise, enemy forces may attempt to cross through certain stratigical areas or cross fixed borders. Identifying enemy intrusion into these stratigical areas requires continuous aerial surveillance or other type of surveillance and a constant effort to halt enemy action. Once enemy forces enter or cross through the stratigical area, a swift "sensing to striking" time is required in order to halt enemy forces. The constant surveillance requirement, followed by a swift and accurate striking capability is often unmet by many armed forces.

Defense industries are engaged in developing motion detection capabilities within confined areas and along borders, aimed to enhance early detection of hostile forces movement. Motion sensing is achieved using various detectors that are placed within the area of interest and communicate with a central command post, and indicate any motion within the selected area of interest.

The complete process of eliminating enemy forces from entering into or crossing through predefined areas requires an autonomous striking capability. This autonomous striking capability should supplement the accurate detection and complete the task of reducing the enemy forces from entering certain areas. This sensing and striking system should essentially "close off" entire areas or eliminate possible border crossing attempts by the enemy forces. Such an autonomous striking system is described below. The basic system described below may be added to any suitable conventional sensing system and allows swift and accurate enemy forces neutralization within predefined confined areas.

The various known sensing systems all work in a similar fashion. The sensors indicate the exact position and detect the motion of enemy forces within a predefined area of interest. The sensing systems are either deployed from an aircraft in various forms, launched using ground missiles or manually positioned by ground forces. Alternative sensing systems are aerial or other systems capable of identifying and tracking movement within a predetermined area.

The goal of the sensing systems is to fully cover a complete area of predetermined size and positively detect any enemy motion within the area. The sensing system transmits the position and motion of the enemy forces to a command and control center that can select an appropriate reaction in order to neutralize the threat. In most conventional striking systems, a command and control center is advised by the sensing system when enemy forces enter the selected area of interest. The command and control center must select and deploy conventional neutralizing agents. This "loop closing" process required in order to eliminate the missile launching threat is time consuming and is often inefficient.

Gorman, in U.S. Pat. No. 6,584,879, teaches a system for disabling time-critical targets within a designated geographical area. The system includes a plurality of guided missile launchers deployed in the geographical area. Each launcher includes a guided missile that is launched vertically. When a target is detected in the geographical area, a command center instructs one or more of the launchers to launch their guided missiles. The launched missile(s) then home in on the target, either autonomously or under external guidance. The Gorman patent is incorporated by reference for all purposes as if fully set forth herein.

SUMMARY OF THE INVENTION

The present invention, which we call Wide Area Neutralizer (WAN), is a method and system for autonomously neutralizing time critical and moving targets of various forms within a confined area. WAN is made up of numerous ground-placed autonomous launchers that deliver precise munitions to a predefined area. The WAN links to any form of sensing system that detects enemy force ground movement within the area of interest. The present invention automatically awakes upon reception of an activation signal from a sensing system or from a command center and autonomously delivers accurate munitions that neutralize enemy forces within the confined sensed area.

According to the present invention there is provided a weapon system including: (a) a plurality of WAN components, each WAN component including: (i) a warhead, (ii) a launch mechanism for launching the warhead, (iii) an aiming mechanism for aiming the launch mechanism to launch the warhead in a desired direction, and (iv) a controller that, upon receipt of a command to aim and launch the warhead, operates the aiming mechanism to aim the warhead in the desired direction and then operates the launch mechanism to launch the warhead; (b) a WAN component deployment mechanism for deploying the plurality of WAN components in a defended area; and (c) a command center for instructing the controller of each of at least one of the WAN components to aim and launch the warhead of the each WAN component at a target that has been detected in the defended area.

According to the present invention there is provided a method of defending an area, including the steps of: (a) deploying a plurality of WAN components in the area, each WAN component including: (i) a warhead, (ii) a launch mechanism for launching the warhead, (iii) an aiming mechanism for aiming the launch mechanism to launch the warhead in a desired direction, and (iv) a controller that, upon receipt of a command to aim and launch the warhead, operates the aiming mechanism to aim the warhead in the desired direction and then operates the launch mechanism to launch the warhead; (b) upon detecting and locating a target in the area: (i) to identifying which at least one of the WAN components should launch the warhead thereof towards the target, and (ii) commanding each identified WAN component to launch the warhead thereof towards the target.

A basic weapon system of the present invention includes a plurality of WAN components, a WAN component deployment mechanism and a command center. Each WAN component includes a warhead, a launch mechanism for launching the warhead, an aiming mechanism for aiming the launch mechanism to launch the warhead in a desired direction, and a controller. When the controller receives a command to aim and launch the warhead, the controller operates the aiming mechanism to aim the warhead in the desired direction and then operates the launch mechanism to launch the warhead. The WAN component deployment mechanism is for deploying the WAN components in the defended area. The command center is for instructing each controller of one or more of the WAN components to aim and launch its/their warhead(s) at a target that has been detected in the defended area.

Preferably, the WAN component deployment mechanism includes one or more precision guided munitions, in each of which at least some of the WAN components are housed prior to the deployment of the WAN components and from which the WAN components housed therein are released during the deployment of the WAN components.

Preferably, the weapon system also includes one or more sensors for detecting the presence of the target in the defended area and for reporting to the command center that the target is present in the defended area. Most preferably, the weapon system also includes a sensor deployment mechanism for deploying the sensor(s) in the defended area.

In some preferred embodiments the command center issues its instructions remotely. In other preferred embodiments, the WAN component deployment mechanism deploys the command center in the defended area along with the WAN components.

The payload of the warheads may be lethal or sub-lethal.

Preferably, each WAN component also includes a locator for determining the location of the WAN component when the WAN component is deployed. The WAN component's controller reports the WAN component's location to the command center.

In one set of preferred embodiments, each, of one or more of the WAN components also includes a base on which the launch mechanism is mounted. The aiming mechanism includes a plurality of arms for tilting the base to aim the launch mechanism. In another set of preferred embodiments, each of one or more of the WAN components also includes a base on which the aiming mechanism is mounted, and the aiming mechanism is operative to turn and elevate the launch mechanism relative to the base to aim the launch mechanism.

In some preferred embodiments, each of one or more of the WAN components includes a stacked plurality of warheads. Each warhead includes an eccentrically disposed munitions body. The launch mechanism of such a WAN component launches the warheads individually in succession. The aiming mechanism of such a WAN component turns each warhead, prior to the launching of the warhead, so that the warhead's munitions body faces towards the target. In the example of such a WAN component below, as illustrated in FIGS. 11 and 12, the eccentrically disposed munitions bodies are wedge-shaped segments of circular warheads.

Preferably, the warhead has an axis of circular symmetry. The launch mechanism spins the warhead about the axis of circular symmetry when launching the warhead.

Preferably, each warhead includes a timer. When the command center instructs a WAN component to aim and launch its warhead at the target, the command center instructs the WAN component's controller to set the WAN component's warhead's timer to detonate the warhead after a respective delay subsequent to the launch of the warhead.

The basic method of the present invention is a method of defending an area. A plurality of WAN components of the basic weapon system is deployed in the area. When a target is detected and located in the area, the WAN components) that should launch its/their warhead(s) towards the target are identified and commanded to launch its/their warhead(s) towards the target.

Preferably, the method also includes deploying one or more sensors in the area for detecting and locating the target.

Preferably, deploying the WAN components includes determining the respective locations of the WAN components. Identifying which WAN component should launch its warhead then is based on the respective locations of the WAN components.

In some preferred embodiments, each of one or more of the WAN components includes a stacked plurality of warheads. Upon receiving a command to launch one of the warheads, such a WAN component launches the topmost warhead in the stack.

Preferably, each warhead has an axis of circular symmetry. When a warhead is launched, the warhead also is spun about its axis of circular symmetry.

Preferably, each warhead includes a timer. When a WAN component is commanded to launch its warhead, the WAN component also is commanded to set is warhead's timer to detonate the warhead after a respective delay subsequent to launching the warhead.

In some preferred embodiments, the commanding of the WAN components to launch their warheads is effected remotely. In other preferred embodiments, a command center that autonomously commands the WAN components to launch their warheads is deployed in the area along with the WAN components.

BRIEF DESCRIPTION OF THE DRAWINGS

Various embodiments are herein described, by way of example only, with reference to the accompanying drawings, wherein.

DESCRIPTION OF THE PREFERRED EMBODIMENTS

Figure 1:
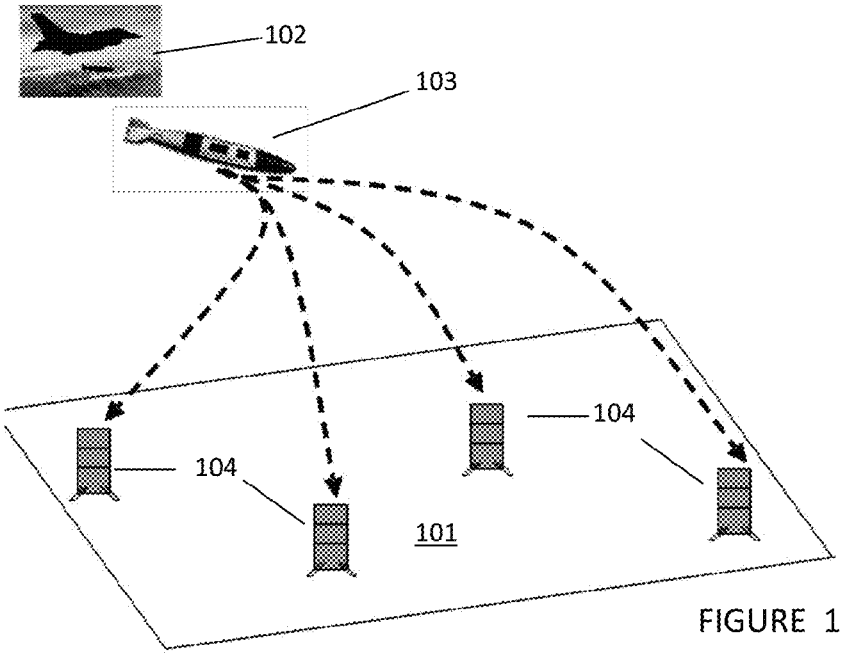
FIG. 1 shows the deployment of a weapon system of the present invention.

The principles and operation of a Wide Area Neutralize (WAN) according to the present in invention may be better understood with reference to the drawings and the accompanying description.

The WAN system is an automatic striking system that delivers accurate munitions to a predefined area within seconds from activation. The WAN system includes various independent sub systems called WAN components that are placed within the area of interest. Following ground positioning, each WAN component remains dormant for months and at the same time is ready for an activation and launching signal. An electric power source (such as a long-lasting battery) powers the WAN component signal receiver at all times and also powers all other electric WAN aiming and launching sub-units. Upon relevant signal reception, the receiver activates the WAN aiming and arming sub-units. Aiming is performed by the WAN processing sub-unit, which calculates the required warhead launch heading and angle. A WAN component electric motor system lifts and positions the warhead at a required launch beading and angle. A gas generator or other type engine launches the warhead upon relevant signal reception. The launched warhead contains a munitions body. The munitions body detonates at a certain height and position along the warhead flight route, releasing numerous metal fragments toward the ground, so a predefined area of destruction is created. This area of destruction is calculated to cover the entire radius of possible motion of the enemy forces from the time of sensor detection to the time of metal fragment ground impact. More than one warhead may be fired at a single area in order to ensure complete and vast coverage of a large area of interest.

The system includes the following sub-systems:

1. Weapon delivery system—the WAN components are packed into a PGM (precision guided munition)—type weapon delivery system such as a JDAM-based delivery system or a MLRS-based delivery system. The weapon delivery system is launched from an aircraft or from a missile launcher and is aimed at the predetermined area of interest. The weapon delivery system releases the WAN components at a pre-determined height above the ground. The WAN components are dispersed in the air and fall to the ground. A statistical analysis of the WAN components' spread ensures complete coverage of the area of interest.

2. WAN components—Each WAN component is an autonomous weapon striking component. Upon arrival at the ground the position of each WAN component is transmitted to a command center. The WAN components remain dormant, preferably for months or even longer, awaiting an activation signal from the command center. When the command center receives a signal from the sensing system, one or more specific WAN components is/are activated and a target position is transmitted to the WAN component(s). The WAN component(s) "wake(s) up" and aim(s) its/their warhead(s) at the required striking area.

3. Warhead—The warhead consists of a munitions body and, in some embodiments, a rocket or gas generator for launching the warhead. The warhead is stored within the WAN component and is launched when the WAN component receives a launching signal. The warhead is launched from the WAN component along a ballistic trajectory calculated by the WAN processing sub-unit. At a certain predetermined point along the trajectory, the munitions body explodes.

4. Munitions body—stored within the warhead and explodes at a predetermined position along the warhead trajectory. For military applications, where lethality is desired, the munitions body includes numerous typical metal fragments which are released toward the ground upon detonation. The metal fragments create a fixed, calculated destruction area that covers the last known enemy forces position and any likely movement from the last known position. Such metal fragments are an example of what is called a "lethal payload" in the appended claims. For civilian (police applications such as border control, the munitions body includes a device such as a net, or substances such as a mixture of tear gas an pepper gas, that repel and/or immobilize and/or incapacitate intruders without causing fatal injuries. Such a device or substance is an example of what is called a "sub-lethal payload" in the appended claims.

Figure 2:
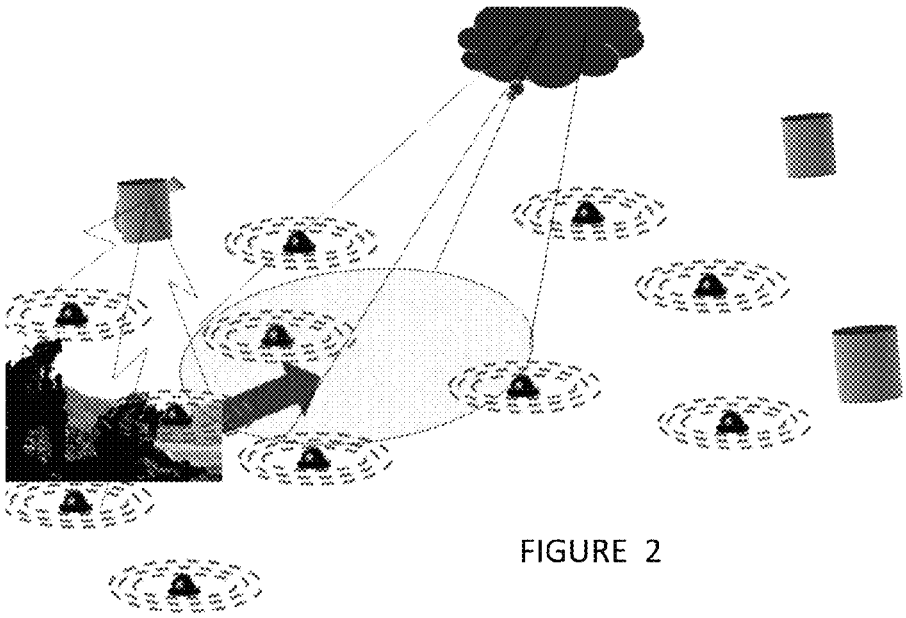
FIG. 2 illustrates the operation of a weapon system of the present invention.

Referring now to the drawings, the major components of the system are illustrated in FIG. 1 and FIG. 2. The system components are designated by the following reference numerals:

| | |
|---|---|
| 101 | Preselected area of interest. |
| 102 | Aircraft used as the vehicle for Weapon Delivery System deployment. |
| 103 | Weapon Delivery System |
| 104 | WAN Components released from Weapon Delivery System |
| 105 | Motion sensing system |
| 106 | Enemy forces within area of interest |
| 107 | WAN component selected for activation and firing |
| 108 | Warhead launched from WAN component |
| 109 | Munitions body activation and explosion at selected position along warhead track |
| 110 | Destruction area created by metal fragments released during munitions body explosion. |
| 111 | Command and Control Center |

In some embodiments of the WAN system, command and control center is a manned command and control center 111 that is remote from the rest of the system. Other embodiments of the WAN system are autonomous. In these autonomous embodiments of the system, command and control center 111 is deployed in area of interest 101 along with the rest of the system. In these autonomous embodiments of the system, command and control center 111 receives the position and direction of motion of enemy forces 106 from sensors 105, automatically selects one or more WAN components 104 to attack enemy forces 106 and transmits the appropriate activation signals to these WAN components 104. In yet other embodiments, the functionality of command and control center 111 is distributed between a remote manned portion and a local portion that is deployed in area of interest 101 along with the rest of the system. The local portion of command and control system 111 is configured so that the operators of the remote manned portion of command and control system 111 can switch the local portion between a remote control mode in which the operators of the remote manned portion operate the system via the local portion and an autonomous mode in which the local portion operates the system autonomously.

FIG. 1 shows WAN components 104 deployed areally in area of interest 101. For some applications, such as border control, WAN components 104 are deployed in a line.

Various preferred embodiments exist for each of the sub-systems of the entire striking system. These preferred sub-systems embodiments are separately described in each of the following sections.

Weapon Delivery System Embodiments

Weapon delivery system 103 is designed to deliver and spreads WAN components 104 within area of interest 101. In one embodiment of the system, weapon delivery system 103 is a JDAM-based precision-guided munition (POM), similar to a GBU-31 or a GBU-32, launched from an aircraft. Numerous WAN components 104 are packed within each JDAM PGM. The number of WAN components 104 in each JDAM PGM depends on the physical size and volume of each WAN component 104. Packing optimization of WAN components 104 into a JDAM PGM is necessary.

Figure 3:
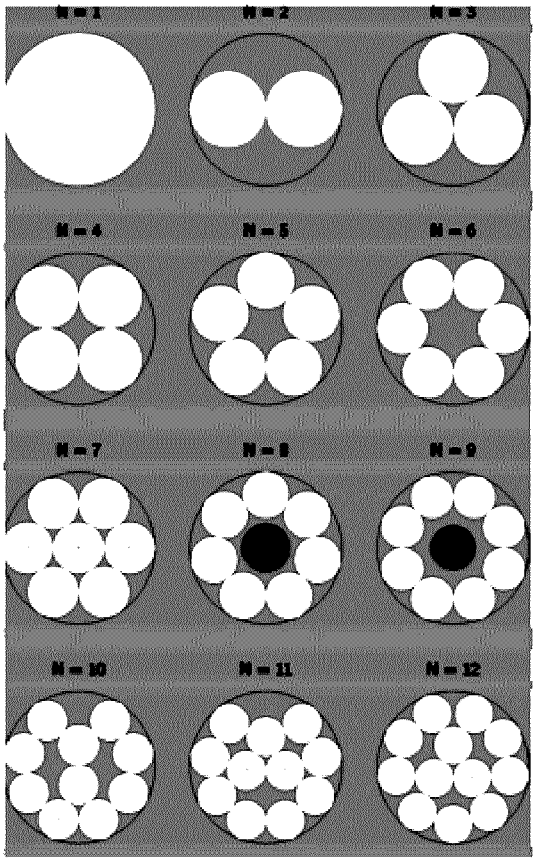
FIG. 3 shows various packing options for WAN components in a JDAM PGM delivery system.

An analysis of different packing options within the JDAM PGM diameter is described herein and in FIG. 3:

Nominal diameter for the JDAM PGM: 457 mm

JDAM PGM wall thickness: 3 mm

- 7 WAN components 104 in cross section: each 150 mm diameter
- 4 WAN components 104 in cross section: each 186 mm diameter
- 3 WAN components 104 in cross section: each 209 mm diameter
- 1 WAN components 104 in cross section: 451 mm diameter In a second preferred embodiment of the system, weapon delivery system 103 is a MLRS (Multiple Launch Rocket System) PGM launched from a MLRS launcher. If WAN components 104 are packed into a MLRS PGM missile a WAN component packing optimization process is performed according to the WAN components' size and volume.

Figure 4:
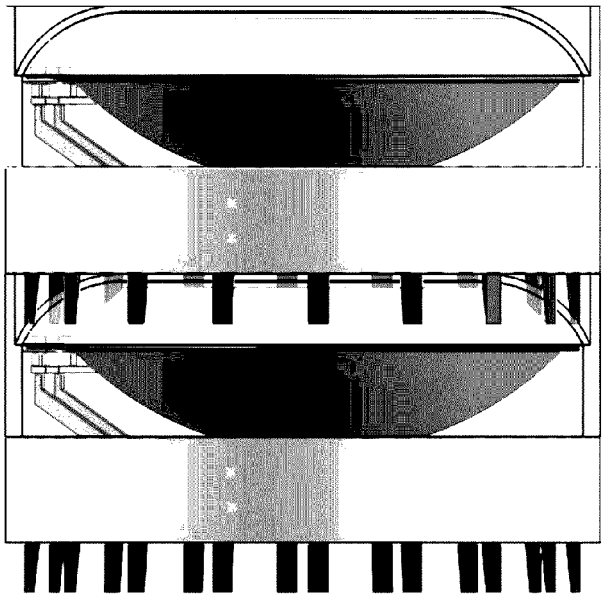
FIG. 4 shows stacking of bowl-shaped WAN components in a JDAM PGM delivery system.

If the diameter of WAN components 104 is the nominal diameter of Weapon Delivery System 103, the WAN components 104 optionally are layered one over another within Weapon Delivery System 103. This embodiment is illustrated in FIG. 4 for the bowl-shaped WAN components 104 described below.

Small explosive charges in weapon delivery system 103 explode and disrupt the fuselage of weapon delivery system 103 a few hundred meters above the ground, causing all the packed WAN components 104 to randomly disperse in all directions. For each weapon delivery system 103 and WAN component 104 combination, a statistical analysis is performed to ensure that WAN components 104 hit the ground in a pattern such that the entire area of interest is covered by the WAN components' munitions. WAN components 104 activate following ground placement and transmit their exact position and status to the automated command center. WAN components 104 are now ready for activation when an activation signal is received from the command center.

The weapons delivery system also is used to deploy sensors 105 in area of interest 101.

WAN Component Embodiments

WAN components 104 remain dormant as long as no threat enters the area of interest. Upon enemy force 106 entry into sensing area 101, sensor system 105 detects the position and movement of the enemy. Sensing system 105 then transmits this information to the command center. The command center selects a single WAN component 107 or several WAN components 107 to react to the threat. An activation signal indicating the position and motion of target 106 is transmitted to the selected WAN components 107.

WAN components 107, which have been dormant from deployment until the activation signal arrival, undergo the required procedures for warhead activation and launching. When the command center transmits a launching signal to the activated WAN component 107, the warhead is fired.

Figure 5:
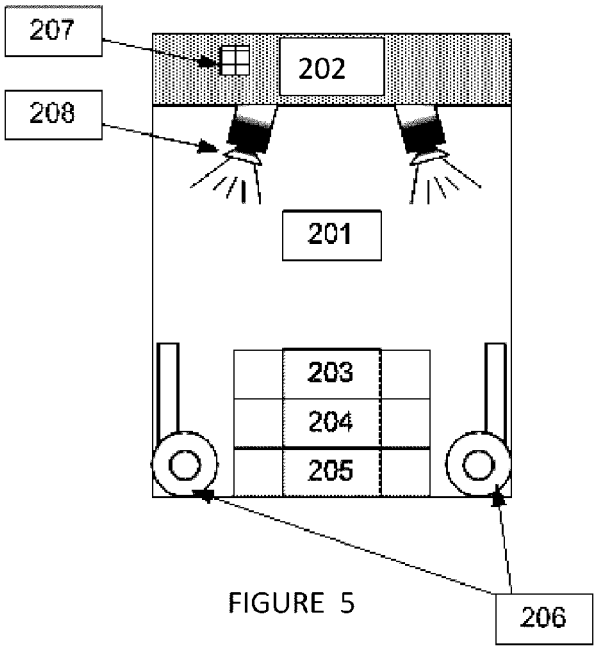
FIG. 5 presents an exemplary packing arrangement of sub-units in a WAN component.

WAN component 104 includes several sub-units that must be packed into WAN component 104, regardless of its type, shape and size. The following table lists the required sub-units and FIG. 5 illustrates one possible sub-units packing arrangement:

| | |
|---|---|
| 201 | Packaging cylinder |
| 202 | Warhead |
| 203 | Communication unit |

-continued

| | |
|---|---|
| 204 | Controller |
| 205 | Location measuring device (typically a GPS receiver) |
| 206 | Pan and tilt unit |
| 207 | Timer |

Figure 6:
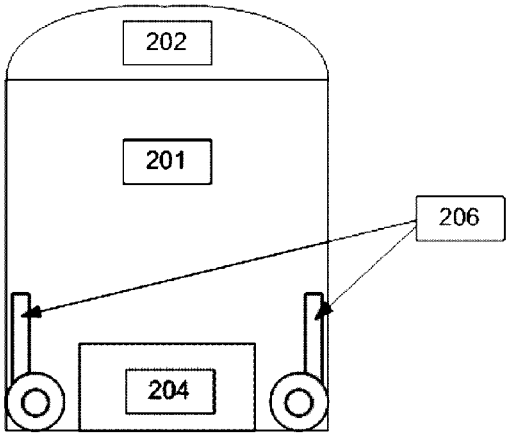
FIGS. 6 and 6A illustrate a WAN component with pan and tilt arms.
Figure 6A:
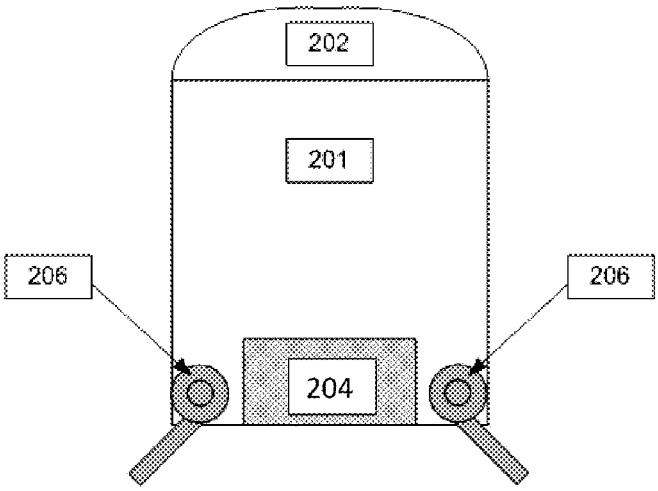

A number of WAN component embodiments are envisioned. Any or all of such embodiments may be deployed in area of interest 101, depending on the anticipated threat. The WAN component embodiments are hereby described:

In one preferred embodiment of WAN component 104 a large diameter cylinder (about 450 mm—the inner diameter of a GBU-31 JDAM PGM) is used to house all required sub-units, aim and fire the warhead. FIG. 6 illustrates the large cylindrical option.

In this embodiment WAN component 104 includes a large packaging cylinder 201 with pan & tilt arms 206 that aim warhead 202 when an activation signal is received from the command center.

Upon WAN component 104 activation signal reception, arms 206 tilt WAN component 104 to the required heading and launch angle. When the command center transmits a launching signal, warhead 202 is launched towards that required heading and at that required launch angle.

Figure 7:
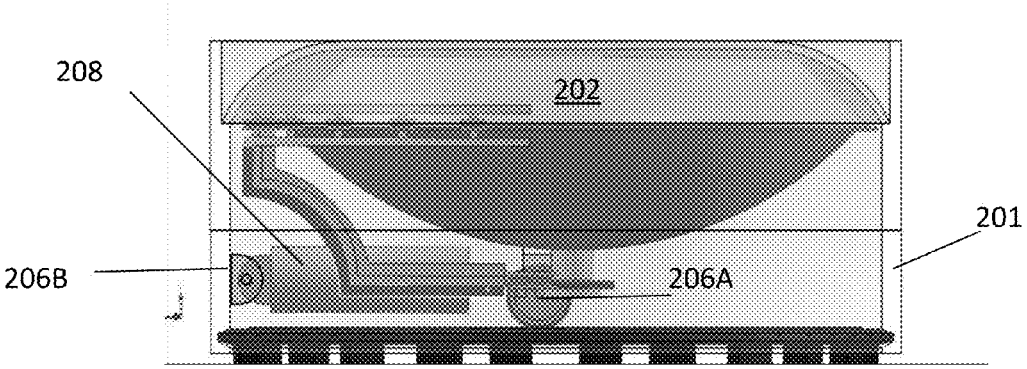
FIGS. 7-8B illustrate a bowl shaped WAN component.
Figure 8:
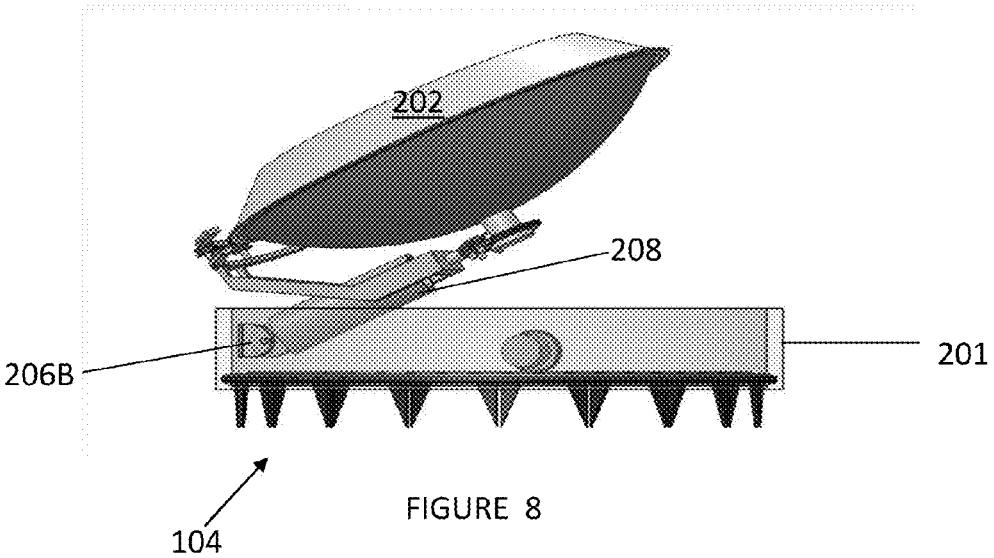

In a second preferred embodiment WAN component 104 is "bowl shaped." This component 104 contains all required sub-units previously described in this section only packed to fit into the specific component size and volume limitations. This WAN component 104 includes a circular shaped warhead 202 positioned at the center of the component, while all other required sub-units are placed in the perimeter and within warhead 202. FIG. 7 illustrates this WAN component 104 embodiment:

In the embodiment of FIG. 7, pan and tilt sub-unit 206 is packed within packaging cylinder 201 and upon activation a plate 206A containing all warhead aiming and launching sub-units is rotated along with warhead 202 to the desired launch heading. The rotated plate 206A also contains a vertical tilt unit 206B that tilts warhead 202 to the required launching angle. Once the required launch heading and angle is achieved, a gas generator or other form of launching piston 208 launches warhead 202 with a predetermined force creating a desired warhead velocity and aerial track 108. FIG. 8 illustrates this WAN component 104 embodiment following vertical tilt to the selected launch angle.

Figure 8A:
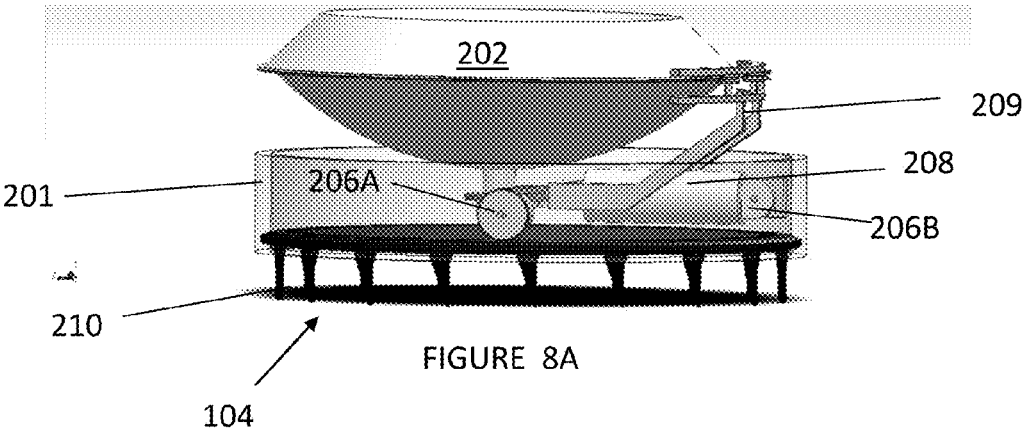
Figure 8B:
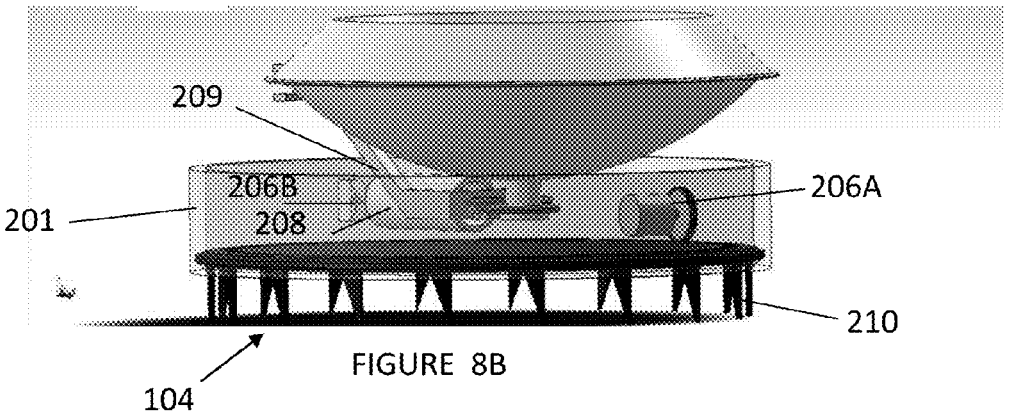

FIGS. 8A and 8B along with the following table indicate the various components and sub-units packed into the "bowl shaped" WAN component 104.

| | |
|---|---|
| 201 | Packaging cylinder |
| 202 | Warhead - Containing Munitions body, Detonation timer, Communication unit, Controller, Ground distance measuring unit. |
| 206 | Pan and tilt unit - contains a base plate rotating unit for warhead heading fixation (206A) and a vertical tilt unit for launching angle fixation (206B). |
| 208 | Launching Piston - producing the required force for warhead launching and spinning. |
| 209 | Piston arms - transfer the launching force from the piston to the warhead. These arms launch the warhead forward and produce a horizontal spin of the warhead around its central axis. |
| 210 | Ground fixed unit including ground penetrating legs |

Warhead Embodiments

Numerous warhead 202 embodiments may be selected. The selection of warhead 202 depends on a number of factors. Warhead 202 size and shape determines the overall size and shape of the WAN component 104 that houses warhead 202 prior to its launching. The desired destruction area 110 may affect the type of warhead 202 selected. The desired warhead aerial track 108 and WAN component destruction area radius is also determined by the type of selected warhead 202. Each warhead 202 creates a specific destruction area 110 size and metal fragment density.

In one warhead 202 embodiment warhead 202 is launched vertically and detonates at a certain altitude above ground. This warhead 202 embodiment includes the following sub-units:

| | |
|---|---|
| 301 | A vertical lift rocket |
| 302 | A central pole that detonates at a fixed altitude above ground |
| 303 | An electronic box containing communication and data processing components |
| 304 | Munitions bodies arranged around the central pole. |

Figure 9:
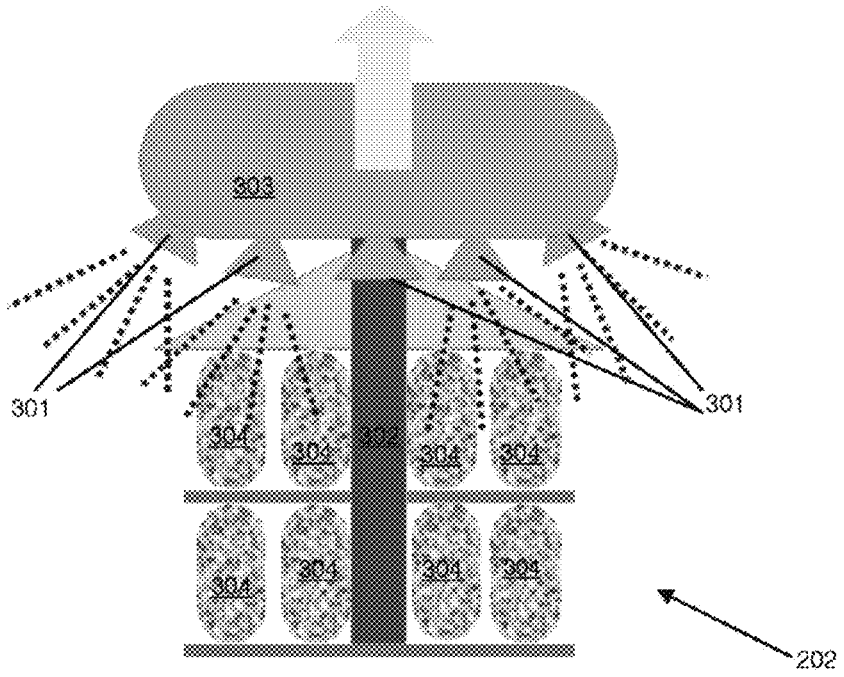
FIG. 9 illustrates a warhead with munitions bodies packed around a central explosive pole.
Figure 10:
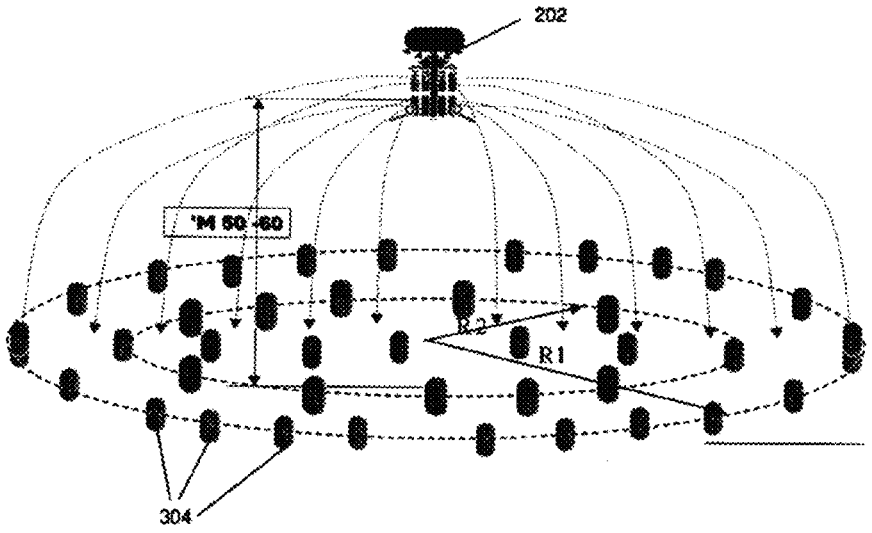
FIG. 10 shows how the munitions bodies of the warhead of FIG. 9 are deployed when the central pole is detonated.

Vertical lift rocket 301 lifts warhead 202 to a desired position and altitude. An electronic control box 303 with communication and processing components measures the warhead altitude above the ground. When warhead 202 reaches the predetermined position at the desired altitude above the ground, central pole 302 explodes, releasing munitions bodies 304 in all directions. FIG. 9 illustrates this embodiment of the launched warhead 202. FIG. 10 illustrates this warhead 202 embodiment following central pole 302 explosion and munitions bodies 304 spread and aerial track towards the ground detonation.

In the embodiment of FIG. 9 munitions bodies 304 are spread at a fixed distance from each other, each creating a known destruction area upon final detonation. The complete area of destruction 110 is created by the sum of all munitions bodies' 304 destruction areas and is marked as R1 in FIG. 10. A different inner munitions bodies density and therefore destruction area particle density exists at the center of the entire destruction area 110 (marked R2 in FIG. 10).

Figure 11:
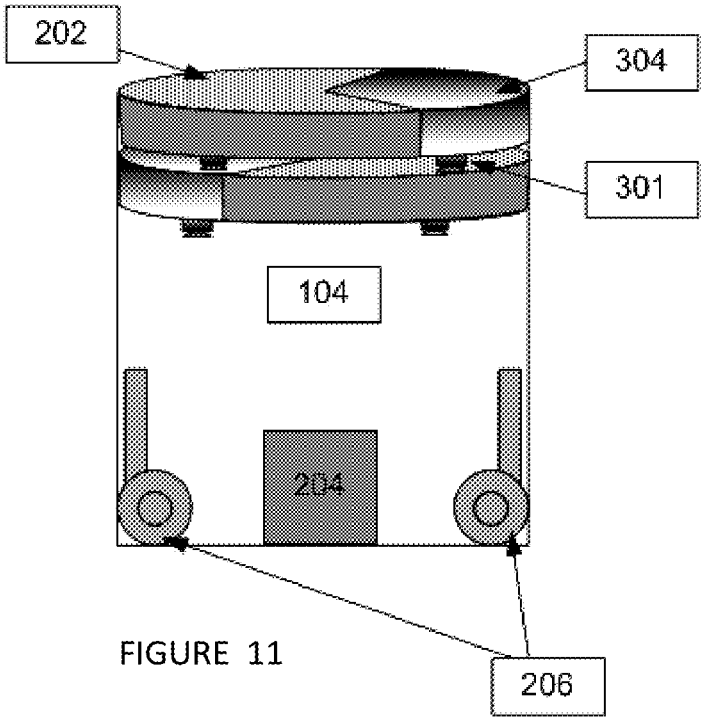
FIG. 11 illustrates a circular warhead with angular munitions bodies.
Figure 12:
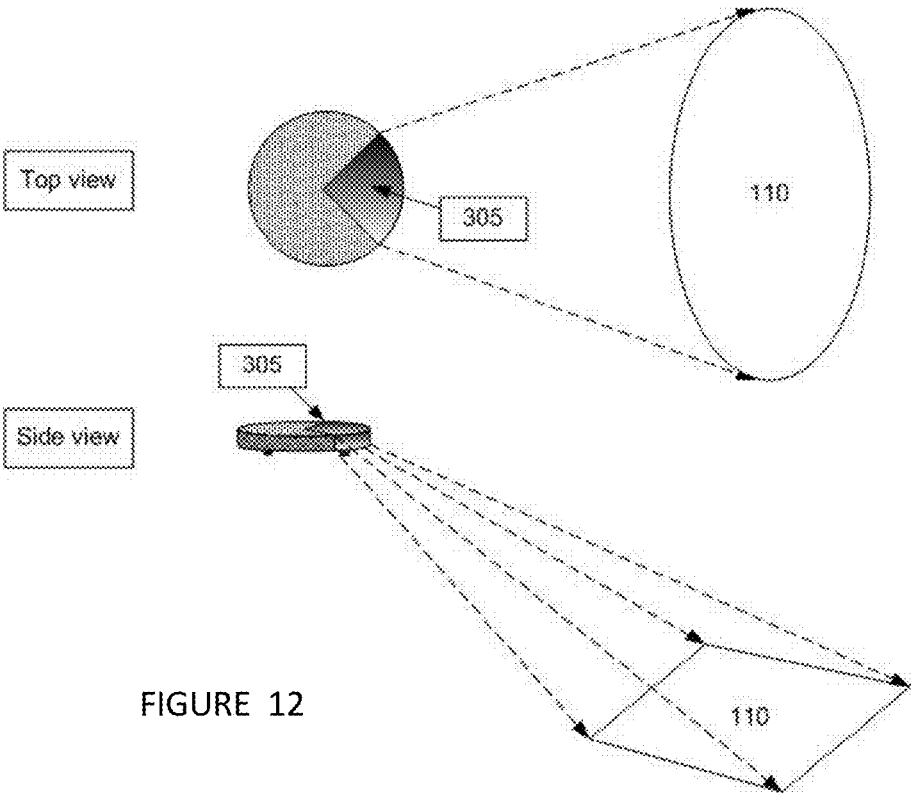
FIG. 12 illustrates detonation of one of the angular munitions bodies of the warhead of FIG. 11.

In a second embodiment of warhead 202, as illustrated in FIG. 11, two or more circular warheads 202 are stacked one over another within a barrel shaped WAN component 104. Each warhead 202 includes an angular wedge-shaped munitions body 304. Upon activation, the is previously dormant WAN component 104 levels using an electric motor aiming system. An electric motor rotating system rotates the stack so that wedge 304 of the topmost warhead 202 faces enemy forces 106. Controller 204 programs vertical lift rockets 301 of the topmost warhead 202 to launch topmost warhead 202 to the height above the ground at which the detonation of wedge 304 of the topmost warhead 202 creates the required distruction area 110. At the required height above the ground wedge-shaped munitions body 304 explodes releasing numerous metal fragments, thereby creating an angular shaped destruction area 110. Following the vertical launch of the topmost warhead 202 from WAN component 104, a new warhead 202 that was previously stacked underneath the launched warhead 202 is now on top of the stack and ready for launching upon activation. FIG. 12 is a top view and side view of the circular warhead 202 during munitions body 304 detonation. An angular destruction area 110 is displayed.

Figure 13:
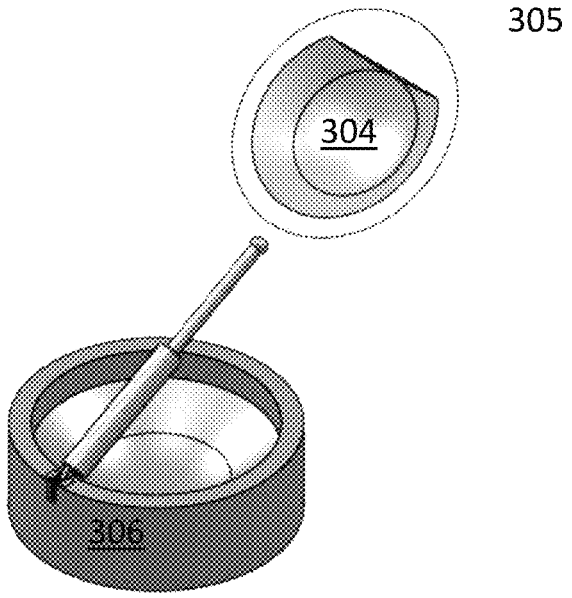
FIGS. 13 and 13A illustrate the launch of a bowl-shaped warhead.
Figure 13A:
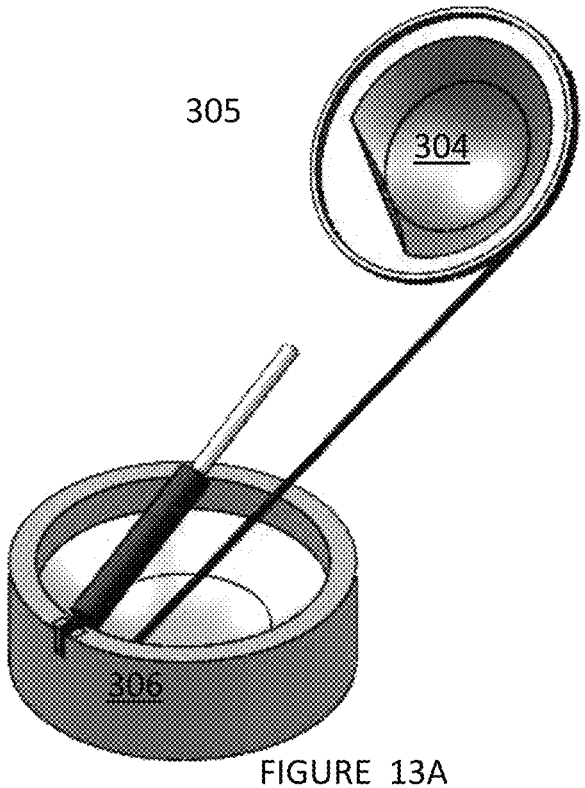
Figure 14:
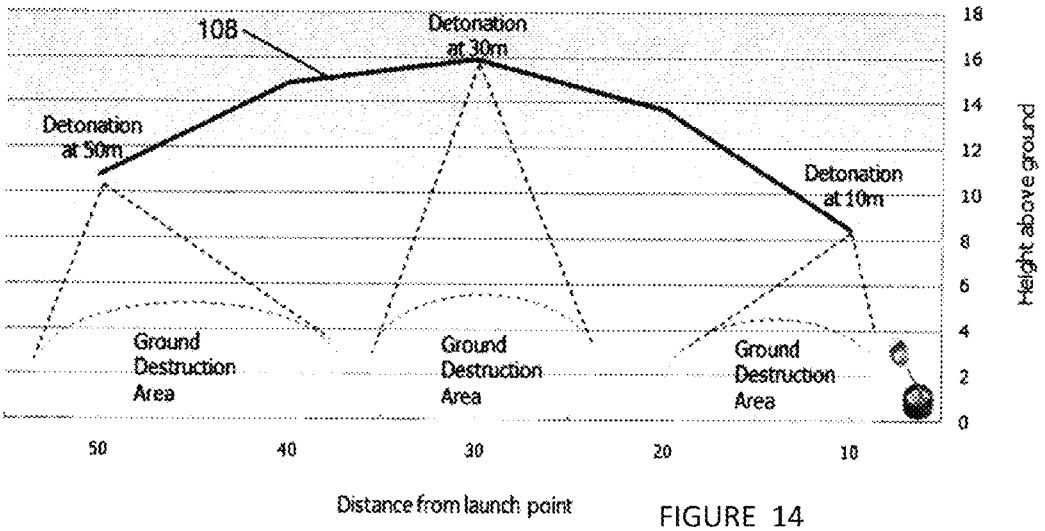
FIG. 14 shows an exemplary trajectory of the warhead of FIG. 13 with different options for timing the detonation of the warhead.

In a third embodiment of warhead 202, a circular "bowl shape" warhead 305 is used. Warhead 305 is placed within a WAN component 306, as shown in FIG. 13, and upon activation is rotated to the desired launch heading. The warhead launching angle is then fixed by a second motor system, and "bowl shape" warhead 305 is launched at a known heading, angle and velocity. When launched, warhead 305 may also spin about its central axis of circular symmetry for stabilizing purposes. This "bowl shaped" warhead 305 is launched in a "frisbee" type flight pattern, in which gyroscopic forces created by horizontal spinning of the warhead 305 account for the warhead 305 balanced flight. In order to create the horizontal rotation of the warhead 305 during launch, a rope may be attached to the circumference of the "bowl shaped" warhead. During warhead 305 launch, the attached rope creates a force which spins the warhead 305 around its horizontal axis in addition to the linear warhead launch force, as seen in FIG. 13A. When warhead 305 is launched, a munitions body detonating time is assigned by the control center via signals to controller 204 of WAN component 306 to set timer 207 of warhead 305 appropriately, depending on the position of the desired destruction area. Warhead track 108 is designed so that at any point along warhead flight path 108, munitions body 304 can explode. The munitions body 304 altitude and angle of detonation depends on the detonation position along warhead aerial track 108. The munitions body 304 detonation point variability creates a variable destruction area size and particle density. FIG. 13 shows warhead 305 being launched from within WAN component 306. FIG. 14 illustrates warhead aerial track 108 along with various munitions body detonation possibilities along this track.

Munitions Body Embodiments

The munitions body is an explosive unit densely packed with metallic fragments. Alternatively, a munitions body is an explosive unit densely packed with tear gas or pepper spray units. Alternatively, a munitions body is an explosive unit densely packed with a net that traps targets following explosion. The munitions body is carried within the warhead and is designated to explode at a certain point along the aerial track of the warhead. Upon detonation, the metal fragments packed inside the munitions body spread at a known particle density, creating a predetermined and calculated area of destruction. Various munitions body embodiments create a wide variety of destruction area sizes and particle densities. Depending on the warhead aerial track and detonation point, the munitions body particle density must be sufficient to completely neutralize any enemy movement within the designated area of interest.

Figure 15:
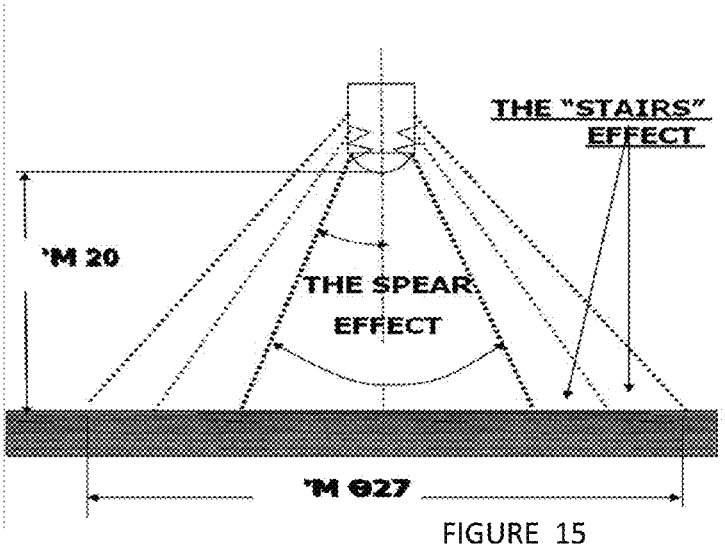
FIG. 15 shows a warhead with a stair style munitions body.

In one embodiment of the munitions body a "stair style" munitions body is packed into any warhead. The munitions body detonates at a known altitude above the ground creating a destruction area that consists of various metal fragment densities. The innermost destruction area consists of metal fragments that detonate from the center munitions body segment. The second perimeter destruction area is made up of metal fragments that detonate from the second munitions body segment. A third destruction area is made up of metal fragments that detonate from the third munitions body segment. FIG. 15 displays this segmental "stair style" munitions body principle.

Figure 16:
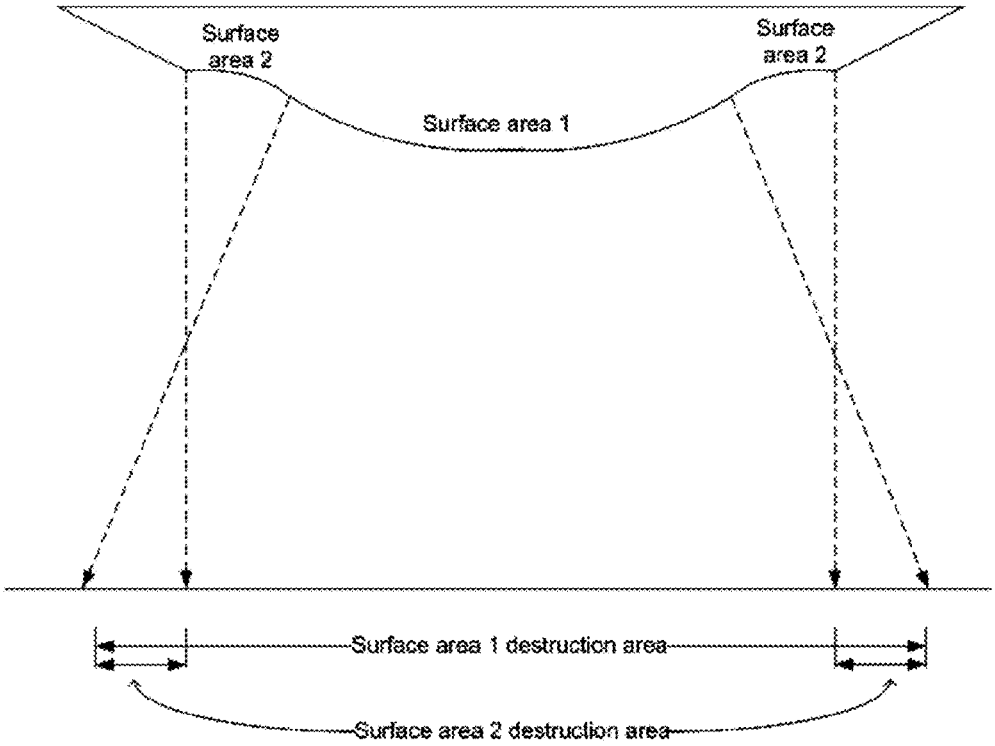
FIG. 16 shows a bowl-shaped munitions body.

In a second embodiment a circular "bowl shaped" munitions body is packed into any warhead. The warhead with the circular munitions body is launched from the WAN component at a fixed angle and velocity, so that a known ballistic course is performed. At a certain point along the warhead flight path, the munitions body detonates releasing numerous metal fragments toward the ground. This creates an area of destruction with variable size and fragment density as previously indicated in the warhead section of this document. In order to create a desired metal fragment density within the entire area of destruction, the "bowl shaped"

munitions body contains various surface area faces, each creating a different particle density destruction area. The sum of all metal fragments surfaces creates a destruction area of known size and particle density which can ensure that any movement within the area is halted. FIG. 16 illustrates the zones of destruction beneath a circular "bowl shaped" munitions body.

Figure 17:
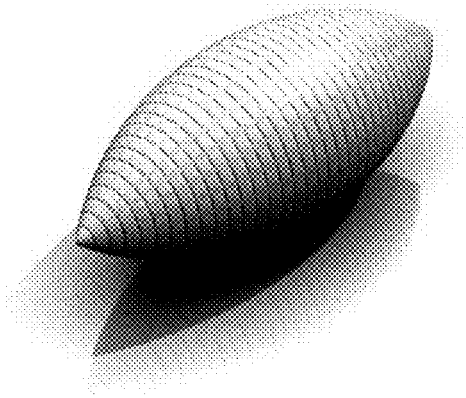
FIGS. 17, 18 and 18A show football-shaped munitions bodies.
Figure 18:
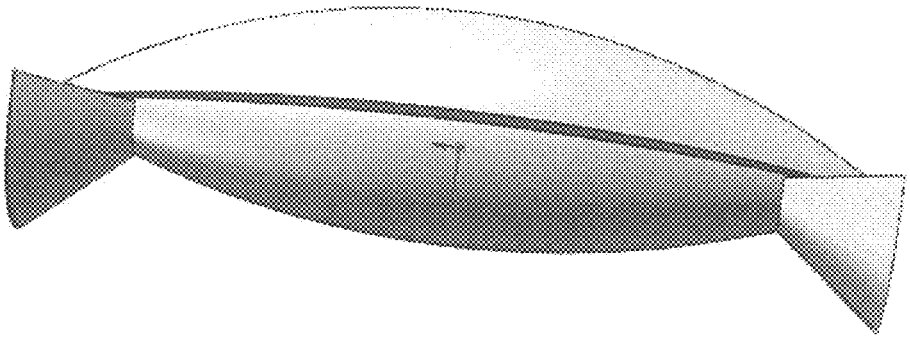
Figure 18A:
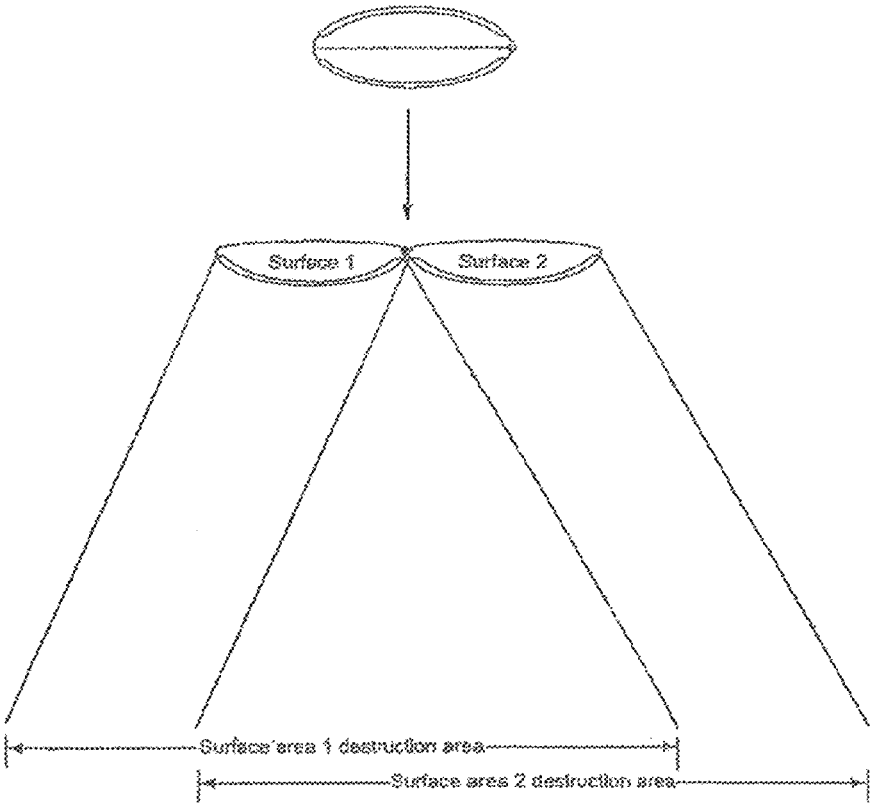

In a third and fourth embodiment a "football" shaped munitions body is packed into any to warhead. This munitions body may be a complete football shape, as illustrated in FIG. 17, or a "candy wrapping" shape in which the original "football" shape has two additional faces on either end, enhancing the metal fragment density at the extreme edges of the destruction area. The "candy wrapping" munitions body is illustrated in FIG. 18. The "football" shaped munitions body illustrated in FIG. 17, may contain metal fragments at the entire circumference of the munitions body and may therefore open up prior to detonation of munitions body and fragment dispersion. This option is described in FIG. 18A.

Figure 19:
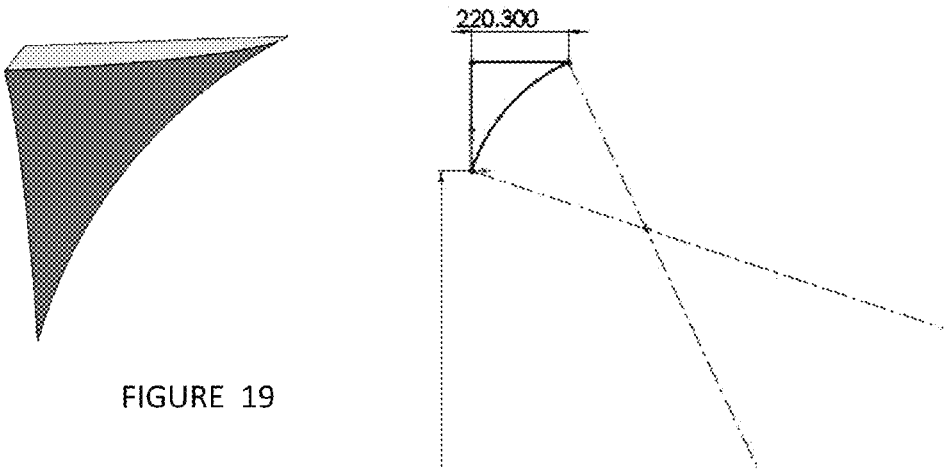
FIGS. 19 and 20 show wedge-shaped munitions bodies.
Figure 20:
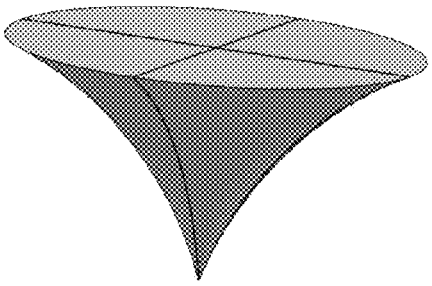

In a fifth and sixth embodiment of the munitions body, a rectangular wedge shaped or cone shaped munitions bodies may be packed into any warhead. The angular munitions bodies are designed to create a more condensed destruction area. FIG. 19 illustrates the rectangular wedge shaped munitions body along with its destruction area analysis. FIG. 20 illustrates a cone shaped munitions body.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A weapon system comprising:

(a) a plurality of WAN components, each said WAN component including:

(i) a warhead formed as a disk having a central axis, (ii) a launch mechanism configured for launching the warhead with a velocity vector substantially perpendicular to the central axis of the disk so that a direction of flight of said warhead is non-parallel to the central axis while imparting stabilizing spin to the disk about its central axis, (iii) an aiming mechanism for aiming said launch mechanism to launch said warhead in a desired direction, and (iv) a controller that, upon receipt of a command to aim and launch said warhead, operates said aiming mechanism to aim said warhead in said desired direction and then operates said launch mechanism to launch said warhead;

(b) a WAN component deployment mechanism for deploying said plurality of WAN components in a defended area; and (c) a command center for instructing said controller of each of at least one of said WAN components to aim and launch said warhead of said each WAN component at a target that has been detected in said defended area, wherein each said warhead includes a timer, and wherein said instructing by said command center of said controller of said each WAN component to aim and launch said warhead of said each WAN component at said target includes instructing said controller of said each WAN component to set said timer of said warhead of said each WAN component to detonate said warhead of said each WAN component after a respective delay subsequent to said launch of said warhead of said each WAN component.

2. The weapon system of claim 1, wherein said WAN component deployment mechanism includes at least one precision guided munition, at least a portion of said plurality of WAN components being housed within each said at least one precision guided munition prior to said deployment and being released from said precision guided munition during said deployment.

3. The weapon system of claim 1, further comprising:

(d) at least one sensor for detecting a presence of said target in said defended area and for reporting said presence to said command center.

4. The weapon system of claim 3, further comprising:

(e) a sensor deployment mechanism for deploying said at least one sensor in said defended area.

5. The weapon system of claim 1, wherein said command center is for remotely instructing said controller of each of said at least one WAN component to aim and launch said warhead of said each WAN component at said target.

6. The weapon system of claim 1, wherein said WAN component deployment mechanism is operative to deploy said command center in said defended area along with said WAN components.

7. The weapon system of claim 1, wherein at least one said warhead includes a lethal payload.

8. The weapon system of claim 1, wherein at least one said warhead includes a sub-lethal payload.

9. The weapon system of claim 1, wherein each said WAN component also includes:

(v) a locator for determining a respective location of said each WAN component upon said deployment of said each WAN component;

and wherein said controller of each said WAN component is operative to report said respective location of said each WAN unit to said command center.

10. The weapon system of claim 1, wherein at least one said WAN component also includes:

(v) a base on which said launch mechanism is mounted;

and wherein said aiming mechanism includes a plurality of arms for tilting said base to aim said launch mechanism.

11. The weapon system of claim 1, wherein at least one said WAN component also includes:

(v) a base on which said aiming mechanism is mounted, said aiming mechanism being operative to turn and elevate said launch mechanism relative to said base to aim said launch mechanism.

12. The weapon system of claim 1, wherein said warhead further comprises a plurality of fragments and an explosive charge deployed for explosively propelling said plurality of fragments in a dispersion pattern on detonation of the warhead.

13. The weapon system of claim 1, wherein the disk has a lower surface that is convex over a majority of its area.

14. The weapon system of claim 13, wherein said warhead further comprises a plurality of fragments deployed for generating, on detonation of the warhead, a diverging substantially conical distribution of explosively-propelled fragments.

15. The weapon system of claim 1, wherein the disk includes a quantity of material for temporarily incapacitating personnel.

16. The weapon system of claim 1, wherein the disk is configured for deploying at least one net for trapping targets.

17. A weapon system comprising:

(a) a plurality of WAN components, each said WAN component including:

(i) a warhead formed as a disk having a central axis, (ii) a launch mechanism configured for launching the warhead with a velocity vector substantially perpendicular to the central axis of the disk so that a direction of flight of said warhead is non-parallel to the central axis while imparting stabilizing spin to the disk about its central axis, (iii) an aiming mechanism for aiming said launch mechanism to launch said warhead in a desired direction, and (iv) a controller that, upon receipt of a command to aim and launch said warhead, operates said aiming mechanism to aim said warhead in said desired direction and then operates said launch mechanism to launch said warhead;

(v) a base on which said launch mechanism is mounted;

(b) a WAN component deployment mechanism for deploying said plurality of WAN components in a defended area; and (c) a command center for instructing said controller of each of at least one of said WAN components to aim and launch said warhead of said each WAN component at a target that has been detected in said defended area, wherein said aiming mechanism includes a plurality of arms for tilting said base to aim said launch mechanism.

* * * * *